US011804195B2

(12) United States Patent
Huang et al.

(10) Patent No.: US 11,804,195 B2
(45) Date of Patent: Oct. 31, 2023

(54) DISPLAY EQUIPMENT, BRIGHTNESS COMPENSATION DEVICE AND BRIGHTNESS COMPENSATION METHOD

(71) Applicant: Novatek Microelectronics Corp., Hsinchu (TW)

(72) Inventors: Po-Hsiang Huang, Hsinchu County (TW); Chia-Hsing Hou, Hsinchu (TW); Yu-Lin Cheng, Hsinchu (TW); Chung-Wen Wu, Yilan County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/242,278

(22) Filed: Apr. 27, 2021

(65) Prior Publication Data

US 2022/0343871 A1 Oct. 27, 2022

(51) Int. Cl.
*G09G 3/36* (2006.01)

(52) U.S. Cl.
CPC ... *G09G 3/3618* (2013.01); *G09G 2310/0291* (2013.01); *G09G 2310/061* (2013.01); *G09G 2310/08* (2013.01); *G09G 2320/064* (2013.01); *G09G 2360/18* (2013.01)

(58) Field of Classification Search
CPC ..... G09G 3/3618; G09G 2310/0291; G09G 2310/061; G09G 2310/08; G09G 2320/064; G09G 2360/18
See application file for complete search history.

(56) References Cited

U.S. PATENT DOCUMENTS

| | | | |
|---|---|---|---|
| 7,038,651 | B2 | 5/2006 | Nitta et al. |
| 7,352,350 | B2 | 4/2008 | Nitta et al. |
| 10,127,882 | B2 | 11/2018 | Kim et al. |
| 11,043,184 | B2 | 6/2021 | An et al. |
| 11,172,160 | B2 | 11/2021 | Kim et al. |
| 2003/0179221 | A1 | 9/2003 | Nitta et al. |

(Continued)

FOREIGN PATENT DOCUMENTS

| | | |
|---|---|---|
| CN | 1455382 | 11/2003 |
| CN | 106971694 | 7/2017 |

(Continued)

OTHER PUBLICATIONS

"Office Action of China Counterpart Application", dated Aug. 18, 2023, p. 1-p. 11.

*Primary Examiner* — Michael A Faragalla
(74) *Attorney, Agent, or Firm* — JCIPRNET

(57) ABSTRACT

The disclosure provides a display equipment, a brightness compensation device, and a brightness compensation method. The brightness compensation device includes a variable refresh rate (VRR) detection circuit and a control circuit. The VRR detection circuit and the control circuit receive a video stream from a video source device, and the video stream includes a VRR video frame. The VRR detection circuit detects a blanking period of the VRR video frame and generates a detection result. The control circuit outputs the frame data of the VRR video frame to the display device during the valid data period of the VRR video frame. The control circuit repeatedly outputs the frame data of the VRR video frame to the display device during the blanking period of the VRR video frame according to the detection result until the blanking period ends.

20 Claims, 4 Drawing Sheets

(56) References Cited

U.S. PATENT DOCUMENTS

| | | | | |
|---|---|---|---|---|
| 2006/0176261 | A1 | 8/2006 | Nitta et al. | |
| 2008/0143729 | A1* | 6/2008 | Wyatt | G09G 5/18 345/501 |
| 2008/0260280 | A1* | 10/2008 | Wu | G09G 3/3648 382/254 |
| 2017/0124934 | A1* | 5/2017 | Verbeure | G09G 3/3611 |
| 2017/0206850 | A1 | 7/2017 | Kim et al. | |
| 2017/0316734 | A1 | 11/2017 | Asai et al. | |
| 2018/0151109 | A1* | 5/2018 | Shim | G09G 3/32 |
| 2018/0247616 | A1 | 8/2018 | Glen et al. | |
| 2019/0045141 | A1* | 2/2019 | Lawrence | H04N 21/2381 |
| 2019/0206356 | A1* | 7/2019 | Kim | G09G 3/3688 |
| 2019/0253662 | A1 | 8/2019 | Kim et al. | |
| 2020/0082781 | A1 | 3/2020 | An et al. | |
| 2023/0108255 | A1 | 4/2023 | Liao | |

FOREIGN PATENT DOCUMENTS

| | | |
|---|---|---|
| CN | 107004398 | 8/2017 |
| CN | 110164350 | 8/2019 |
| CN | 110890073 | 3/2020 |
| CN | 111816109 | 10/2020 |

* cited by examiner

DISPLAY EQUIPMENT, BRIGHTNESS COMPENSATION DEVICE AND BRIGHTNESS COMPENSATION METHOD

BACKGROUND

Technology Field

The disclosure relates to an electronic device, and particularly, to a piece of display equipment, a brightness compensation device, and a brightness compensation method.

Description of Related Art

Variable refresh rate (VRR) technology can be applied to display equipment to prevent frame loss. The VRR technology means that different VRR video frames in a video stream may have different frame durations. Liquid crystal display (LCD) panels are widely used in display equipment to display video streams. Generally speaking, the liquid crystal pixels of an LCD panel have a problem of leakage current. That is, without refreshing the LCD panel, the brightness of the liquid crystal pixels may gradually change as time goes by. For example, the brightness of a video frame having a long frame duration may be lower than the brightness of a video frame having a short frame duration. The VRR technology can enable different VRR video frames to have different frame durations. Therefore, conventional display equipment that adopts the VRR technology may have a problem of screen flickering.

SUMMARY

The disclosure provides a piece of display equipment, a brightness compensation device, and a brightness compensation method to compensate for brightness differences among different variable refresh rate (VRR) video frames.

In an embodiment of the disclosure, the brightness compensation device includes a variable refresh rate (VRR) detection circuit and a control circuit. The VRR detection circuit is adapted for receiving a video stream from a video source device, and the video stream includes a variable refresh rate (VRR) video frame. The VRR detection circuit detects a blanking period of the VRR video frame and generates a detection result. The control circuit is coupled to the VRR detection circuit to receive the detection result. The control circuit is adapted for receiving the video stream from the video source device. The control circuit outputs frame data of the VRR video frame to a display device during a valid data period of the VRR video frame. The control circuit repeatedly outputs the frame data of the VRR video frame to the display device during the blanking period of the VRR video frame according to the detection result until the blanking period ends.

In an embodiment of the disclosure, the brightness compensation method includes steps as follows. A blanking period of a variable refresh rate (VRR) video frame is detected and a detection result is generated by a variable refresh rate (VRR) detection circuit. Frame data of the VRR video frame is output to a display device by a control circuit during a valid data period of the VRR video frame. The frame data of the VRR video frame is repeatedly output to the display device by the control circuit during the blanking period of the VRR video frame according to the detection result until the blanking period ends.

In an embodiment of the disclosure, the display equipment includes a video source device, a brightness compensation device, and a display device. The video source device is adapted for providing a video stream, and the video stream includes a variable refresh rate (VRR) video frame. The brightness compensation device is coupled to an output terminal of the video source device and an input terminal of the display device. The brightness compensation device receives the video stream from the video source device. The brightness compensation device detects a blanking period of the VRR video frame. The brightness compensation device outputs frame data of the VRR video frame to the display device during a valid data period of the VRR video frame. The brightness compensation device repeatedly outputs the frame data of the VRR video frame to the display device during the blanking period of the VRR video frame until the blanking period ends.

In an embodiment of the disclosure, the brightness compensation method of the piece of display equipment includes steps as follows. A brightness compensation device is provided with a video stream by a video source device. The video stream includes a variable refresh rate (VRR) video frame. A blanking period of the VRR video frame is detected by the brightness compensation device. Frame data of the VRR video frame is output to a display device by the brightness compensation device during a valid data period of the VRR video frame. The frame data of the VRR video frame is repeatedly output to the display device by the brightness compensation device during the blanking period of the VRR video frame until the blanking period ends.

Based on the above, in some embodiments, the brightness compensation device is capable of detecting the blanking period of the VRR video frame. The video source device outputs the frame data of the VRR video frame to the brightness compensation device during the valid data period of the VRR video frame but does not output the frame data to the brightness compensation device during the blanking period of the VRR video frame. During the periods of the same VRR video frame, the brightness compensation device not only outputs the frame data of the VRR video frame to the display device during the valid data period but also repeatedly outputs the frame data of the VRR video frame during the blanking period to display device (until the blanking period ends). That is, the display device may keep on refreshing the frame data during the blanking period to supplement the charge leaked from the liquid crystal pixels caused by the leakage current. Therefore, the brightness compensation device may compensate for the brightness difference among different VRR video frames.

In order to make the aforementioned features and advantages of the disclosure comprehensible, embodiments accompanied with drawings are described in detail below.

DESCRIPTION OF THE EMBODIMENTS

Figure 1:
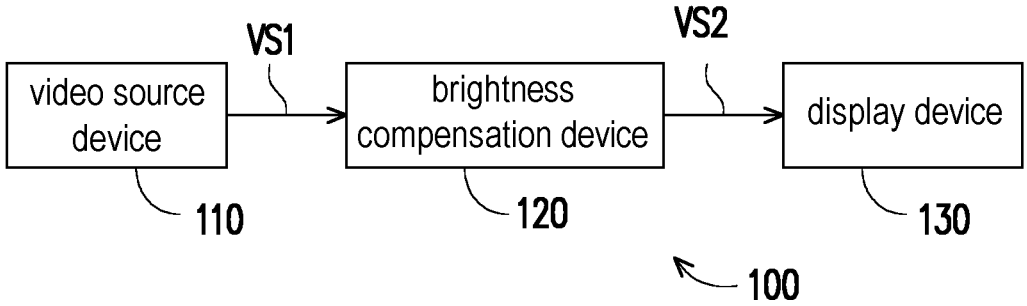
FIG. 1 is a schematic circuit block view illustrating a piece of display equipment according to an embodiment of the disclosure.

The terms "couple/connect" used in this specification (including claims) may refer to any direct or indirect connection means. For example, "a first device is coupled (or connected) to a second device" should be interpreted as "the first device is directly connected to the second device" or "the first device is indirectly connected to the second device through other devices or connection means." The terms "first", "second", and so on used in this specification (including claims) are used to name the elements or distinguish different embodiments or ranges from each other, and should not be construed as the upper limit or lower limit of the number of the elements or as a limitation to the order of the elements. Moreover, wherever appropriate in the drawings and embodiments, elements/components/steps with the same reference numerals represent the same or similar parts. Elements/components/steps with the same reference numerals or names in different embodiments may be cross-referenced.

FIG. 1 is a schematic circuit block view illustrating a piece of display equipment 100 according to an embodiment of the disclosure. The display equipment 100 includes a video source device 110, a brightness compensation device 120, and a display device 130. According to different designs, the implementation of the video source device 110 and/or the brightness compensation device 120 may be hardware, firmware, software (i.e. programs), or combinations thereof.

In terms of hardware, the video source device 110 and/or the brightness compensation device 120 may be implemented as a logic circuit on an integrated circuit. The related functions of the video source device 110 and/or the brightness compensation device 120 may be implemented as hardware by adopting hardware description languages (e.g., Verilog HDL or VHDL) or other suitable programming languages. For example, the related functions of the video source device 110 and/or the brightness compensation device 120 may be implemented as one or more controllers, microcontrollers, microprocessors, application-specific integrated circuits (ASICs), digital signal processors (DSPs), field programmable gate array (FPGAs), and/or various logic blocks, modules, and circuits in other processing units.

In terms of software and/or firmware, the related functions of the video source device 110 and/or the brightness compensation device 120 may be implemented as programming codes. For example, the video source device 110 and/or the brightness compensation device 120 may be implemented by adopting general programming languages (e.g. C, C++, or a combination of languages) or other suitable programming languages. The programming codes may be recorded/stored in a "non-transitory computer readable medium". In some embodiments, for example, the non-transitory computer readable medium includes read only memory (ROM), a tape, a disk, a card, semiconductor memory, a programmable logic circuit, and/or a storage device. The storage device includes a hard disk drive (HDD), a solid-state drive (SSD), or other storage devices. A central processing unit (CPU), a controller, a microcontroller, or a microprocessor can read the programming codes from the non-transitory computer readable medium and execute the programming codes to implement the related functions of the video source device 110 and/or the brightness compensation device 120.

According to actual designs, in some embodiments, the video source device 110 and the brightness compensation device 120 may be different integrated circuits disposed outside the display device 130. In other embodiments, the video source device 110 may be an integrated circuit disposed outside the display device 130, and the brightness compensation device 120 may be integrated into the same integrated circuit together with the video source device 110. In still other embodiments, the video source device 110 may be an integrated circuit disposed outside the display device 130, and the brightness compensation device 120 may be integrated into the display device 130. In other embodiments, the video source device 110 and the brightness compensation device 120 may be integrated into the display device 130 together.

The brightness compensation device 120 is coupled to an input terminal of the display device 130 to provide a video stream VS2. According to actual designs, in some embodiments, the display device 130 may include a liquid crystal display (LCD) panel. The brightness compensation device 120 is also coupled to an output terminal of the video source device 110. The video source device 110 may provide the brightness compensation device 120 with a video stream VS1, and the video stream VS1 includes one or more variable refresh rate (VRR) video frames. In the embodiment, the implementation details of the VRR video frame are not limited thereto. For example, in some embodiments, the VRR video frame may be a VRR video frame generated by conventional VRR technology or another VRR technology. The details of the conventional VRR technology are not iterated.

Figure 2:
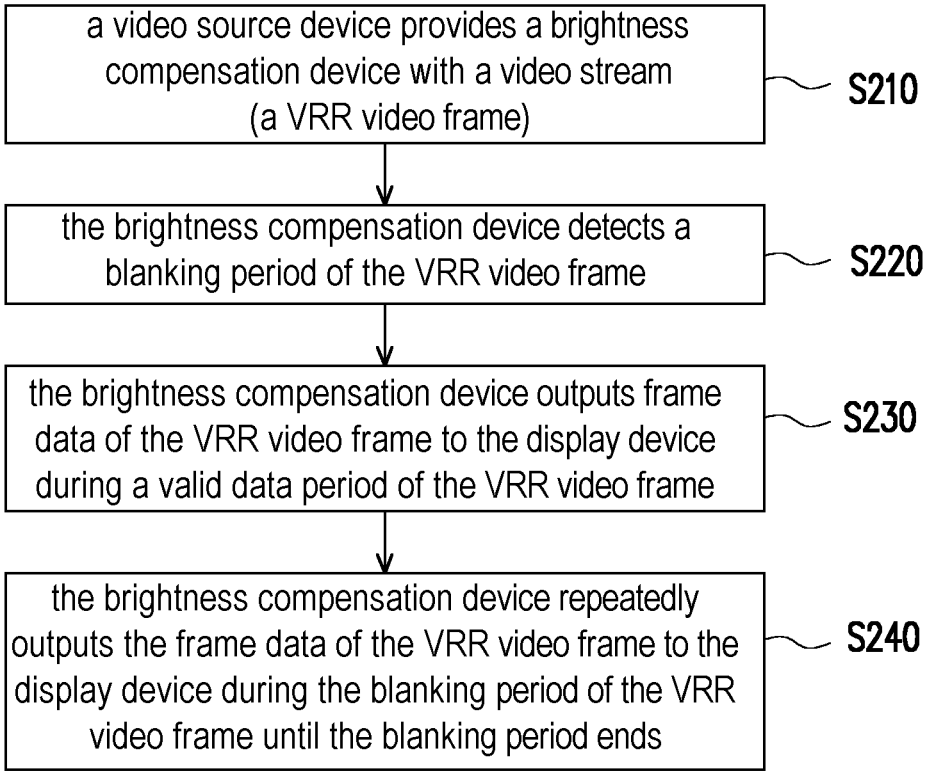
FIG. 2 is a flowchart illustrating a brightness compensation method of the display equipment shown in FIG. 1 according to an embodiment of the disclosure.

FIG. 2 is a flowchart illustrating a brightness compensation method of the display equipment 100 shown in FIG. 1 according to an embodiment of the disclosure. Referring to FIG. 1 and FIG. 2, in step S210, the video source device 110 may provide the brightness compensation device 120 with the video stream VS1. The display equipment 100 shown in FIG. 1 may be any electronic device according to actual designs. For example, in some embodiments, the display equipment 100 may be a notebook computer, a tablet computer, or an all-in-one (AIO) computer, or other computer equipment. In such an embodiment, the video source device 110 may include a graphics processing unit (GPU), a central processing unit (CPU), or other devices that operates based on the VRR technology. The GPU (or CPU, not shown) can generate the video stream VS1 for the brightness compensation device 120.

Figure 3:
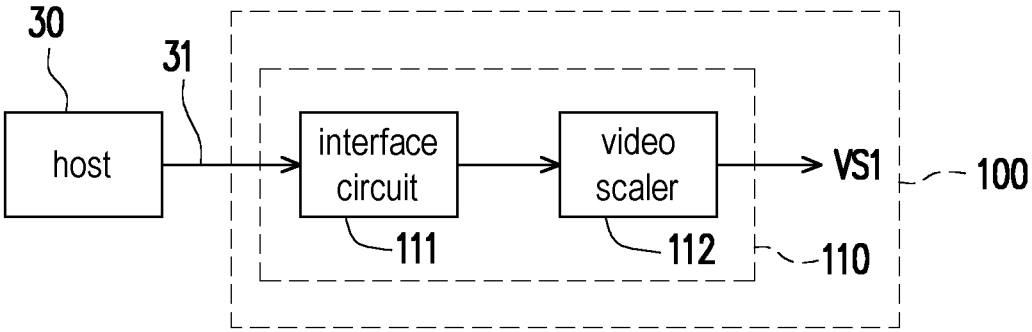
FIG. 3 is a schematic circuit block view illustrating a video source device shown in FIG. 1 according to an embodiment of the disclosure.

In other embodiments, the display equipment 100 may be a monitor, a head mounted display (HMD), or other display equipment. FIG. 3 is a circuit block view illustrating the video source device 110 shown in FIG. 1 according to an embodiment of the disclosure. In the embodiment shown in FIG. 3, the video source device 110 may include a video scaler 112 or other video processing devices. The video source device 110 also includes an interface circuit 111. A host 30 may operate based on the VRR technology and output an original VRR stream 31. The interface circuit 111 may receive the original VRR stream 31 from the host 30 and provide the video scaler 112 with the original VRR stream 31. According to actual designs, the interface circuit 111 may include a universal serial bus (USB) interface circuit, a high definition multimedia interface (HDMI) circuit, a display port (DP) interface circuit, or other transmission interface circuits.

The video scaler 112 shown in FIG. 3 is coupled to the interface circuit 111 to receive the original VRR stream 31. The video scaler 112 may adjust the resolution of the original VRR stream 31 and generate the video stream VS1 for the brightness compensation device 120. According to actual designs, in some embodiments, the video scaler 112 may include a conventional scaler circuit or other scaler circuits.

Referring to FIG. 1 and FIG. 2, the brightness compensation device 120 may receive the video stream VS1 from the video source device 110. In step S220, the brightness compensation device 120 may detect a blanking period of the VRR video frame. Based on the VRR technology, the duration of the blanking period in the VRR video frame is dynamically changed. Generally speaking, the video source device 110 may output frame data (pixel data) to the brightness compensation device 120 during a valid data period of the VRR video frame, but the video source device 110 does not output the frame data (the pixel data) to the brightness compensation device 120 during the blanking period of the VRR video frame.

Figure 4:
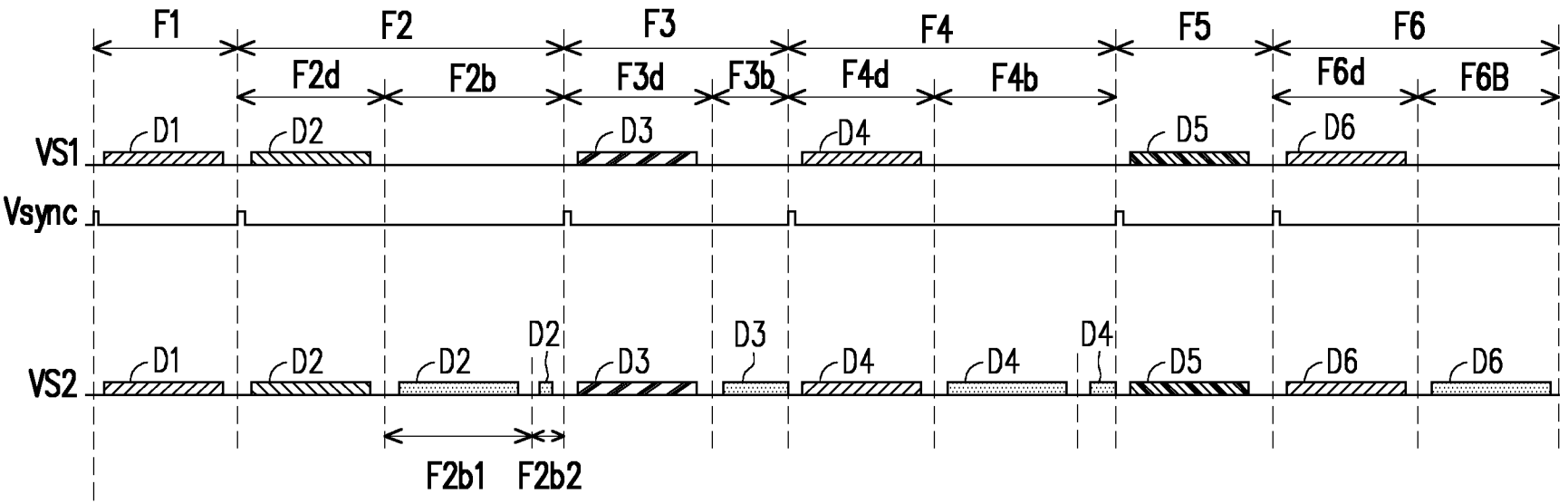
FIG. 4 is a schematic view illustrating timings of video streams shown in FIG. 1 according to an embodiment of the disclosure.

FIG. 4 is a schematic view illustrating timings of the video stream VS1 and the video stream VS2 shown in FIG. 1 according to an embodiment of the disclosure. In FIG. 4, the horizontal axis represents time. For the convenience of description, the time delay is ignored in FIG. 4, and the timing of the video stream VS2 is aligned with the timing of the video stream VS1. In the embodiment shown in FIG. 4, the video stream VS1 includes VRR video frames F1, F2, F3, F4, F5, and F6. Based on the VRR technology, the durations of the VRR video frames F1 to F6 may be different from one another. Each of the VRR video frames F1 to F6 may include the valid data period and the blanking period. For example, the VRR video frame F2 includes a valid data period F2*d* and a blanking period F2*b*, the VRR video frame F3 includes a valid data period F3*d* and a blanking period F3*b*, the VRR video frame F4 includes a valid data period F4*d* and a blanking period F4*b*, and the VRR video frame F6 includes a valid data period F6*d* and a blanking period F6*b*. The blanking periods of the VRR video frames F1 and F5 shown in FIG. 4 are very short (the durations of the blanking periods can even be 0), so no reference numerals are shown to refer to the blanking periods.

The video source device 110 may output the frame data (the pixel data) to the brightness compensation device 120 during the valid data periods of the VRR video frames F1 to F6. For example, by the video source device 110, frame data D1 is output during the valid data period of the VRR video frame F1, frame data D2 is output during the valid data period F2*d* of the VRR video frame F2, frame data D3 is output during the valid data period F3*d* of the VRR video frame F3, frame data D4 is output during the valid data period F4*d* of the VRR video frame F4, frame data D5 is output during the valid data period of the VRR video frame F5, and frame data D6 is output during the valid data period F6*d* of the VRR video frame F6.

During the blanking periods (e.g., the blanking periods F2*b*, F3*b*, F4*b*, and F6*b*) of the VRR video frames F1 to F6, the video source device 110 does not output the frame data (the pixel data) to the brightness compensation device 120. Generally speaking, the liquid crystal pixels of a liquid crystal display (LCD) panel have a problem of leakage current. When the LCD panel is not refreshed, as time goes by, the brightness of the liquid crystal pixels of the LCD panel of the display device 130 may gradually change because of the leakage current. The durations of the VRR video frames F1 to F6 are different from one another. When the display equipment 100 does not include the brightness compensation device 120 (i.e., the video stream VS1 is directly transmitted to the display device 130 to serve as the video stream VS2), the durations when the leakage current happens to the VRR video frames F1 to F6 are different from one another, so flickering occurs on the display of the display device. The brightness compensation device 120 may control the display device 130 to keep on refreshing the frame data during the blanking period to supplement the charge leaked from the liquid crystal pixels of the display device 130 caused by the leakage current. Therefore, the brightness compensation device 120 may effectively compensate for the brightness difference among different VRR video frames.

Referring to FIG. 1, FIG. 2, and FIG. 4, the brightness compensation device 120 may detect the blanking periods (e.g., the blanking periods F2*b*, F3*b*, F4*b*, and F6*b*) of the VRR video frames F1 to F6 in step S220. Moreover, the brightness compensation device 120 may output the frame data D1 to D6 of the VRR video frames F1 to F6 to the display device 130 during the valid data periods (e.g., the valid data periods F2*d*, F3*d*, F4*d*, and F6*d*) of the VRR video frames F1 to F6 (step S230). Therefore, the frame data D1 to D6 may be updated/displayed on the display device 130 during the valid data periods of the VRR video frames F1 to F6.

The brightness compensation device 120 may repeatedly output the frame data D1 to D6 of the VRR video frames F1 to F6 to the display device 130 during the blanking periods (e.g., the blanking periods F2*b*, F3*b*, F4*b*, and F6*b*) of the VRR video frames F1 to F6 until the blanking periods end (step S240). For example, the duration of the blanking period of the VRR video frame F1 is less than a threshold value, so the brightness compensation device 120 does not repeatedly output the frame data D1 to the display device 130 during the blanking period of the VRR video frame F1. The threshold value may be determined according to actual designs. During the periods of the VRR video frame F2, the brightness compensation device 120 not only outputs the frame data D2 of the VRR video frame F2 to the display device 130 during the valid data period F2*d* but also repeatedly outputs the frame data D2 of the VRR video frame F2 to the display device 130 during the blanking period F2*b* (until the blanking period F2*b* ends). That is, the display device 130 may keep on refreshing the frame data during the blanking period F2*b* to supplement the charge leaked from the liquid crystal pixels caused by the leakage current. Therefore, the brightness compensation device 120 may compensate for the brightness difference between different VRR video frames F1 and F2.

Figure 5:
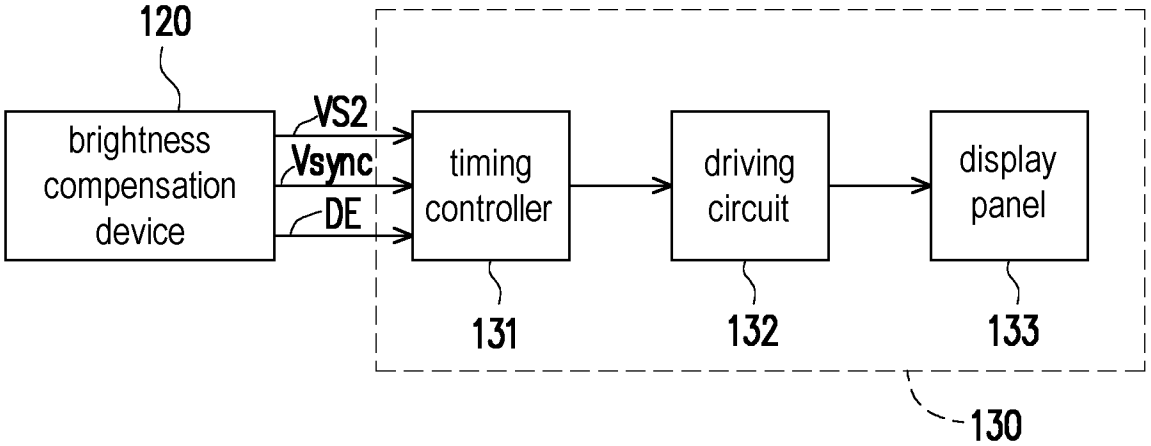
FIG. 5 is a schematic circuit block view illustrating a display device shown in FIG. 1 according to an embodiment of the disclosure.

FIG. 5 is a schematic circuit block view illustrating the display device 130 shown in FIG. 1 according to an embodiment of the disclosure. In the embodiment shown in FIG. 5, the display device 130 includes a timing controller 131, a driving circuit 132, and a display panel 133. According to actual designs, the display panel 133 may include a liquid crystal display (LCD) panel. The driving circuit 132 may drive the display panel 133. According to actual designs, the driving circuit 132 may include a source driver (not shown) and a gate driver (not shown).

Referring to FIG. 4 and FIG. 5, the timing controller 131 is coupled to the brightness compensation device 120. The timing controller 131 may receive the video stream VS2 (e.g., frame data of the VRR video frames F1 to F6), data enabling information DE, and vertical synchronization information Vsync from the brightness compensation device 120. According to actual designs, in some embodiments, the video stream VS2, the data enabling information DE, and the vertical synchronization information Vsync respectively may be transmitted to the timing controller 131 through different wires. In other embodiments, the data enabling information DE and/or the vertical synchronization information Vsync may be embedded in the video stream VS2. The data enabling information DE may indicate the valid data periods of the VRR video frames F1 to F6, and the vertical synchronization information Vsync may indicate the end of the blanking periods of the VRR video frames F1 to F6.

According to the data enabling information DE, the timing controller 131 may control the driving circuit 132 to drive the display panel 133 to display the frame data D1 to D6 of the VRR video frames F1 to F6 during the valid data periods of the VRR video frames F1 to F6. According to the data enabling information DE and the vertical synchronization information Vsync, the timing controller 131 may control the driving circuit 132 to drive the display panel 133 to repeatedly display the frame data D1 to D6 of the VRR video frames F1 to F6 during the blanking periods of the VRR video frames F1 to F6 until the blanking periods end.

For example, due to the control of the timing controller 131, the driving circuit 132 may drive the display panel 133 to display the frame data D1 during the valid data period of the VRR video frame F1. After the transmission of the frame data D1 is completed, the pulse of the vertical synchronization information Vsync appears immediately, so the timing controller 131 may reset the scanning operation of the driving circuit 132 according to the timing of the vertical synchronization information Vsync. Therefore, the timing controller 131 may receive the frame data D2 of the video stream VS2 during the valid data period F2*d* of the VRR video frame F2. After the valid data period F2*d* ends, the pulse of the vertical synchronization information Vsync has not yet appeared, so the timing controller 131 receives the frame data D2 again during a sub-period F2*b*1 of the blanking period F2*b*, and the timing controller 131 drives the display panel 133 by the driving circuit 132 again to display the frame data D2 again during the sub-period F2*b*1. After the sub-period F2*b*1 ends, the pulse of the vertical synchronization information Vsync has not yet appeared, so the timing controller 131 receives the frame data D2 again during a sub-period F2*b*2 of the blanking period F2*b*, and the timing controller 131 drives the display panel 133 by the driving circuit 132 again to display the frame data D2 again during the sub-period F2*b*2. Although the duration of the sub-period F2*b*2 is not long enough to display a complete frame, because the pulse of the vertical synchronization information Vsync appears, the timing controller 131 resets the scanning operation of the driving circuit 132 according to the timing of the vertical synchronization information Vsync. Therefore, the timing controller 131 may receive the frame data D3 of the video stream VS2 during the valid data period F3*d* of the VRR video frame F3. For the implementations of the VRR video frames F3 to F6, refer to the related descriptions of the VRR video frames F1 to F2, and the details are not iterated.

Figure 6:
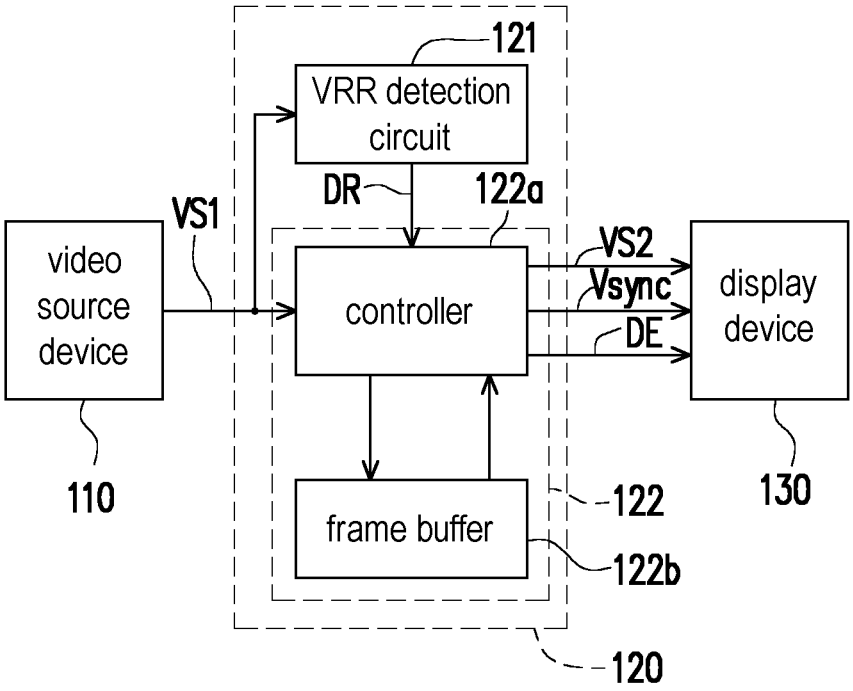
FIG. 6 is a schematic circuit block view illustrating a brightness compensation device shown in FIG. 1 according to an embodiment of the disclosure.

FIG. 6 is a schematic circuit block view illustrating the brightness compensation device 120 shown in FIG. 1 according to an embodiment of the disclosure. In the embodiment shown in FIG. 6, the brightness compensation device 120 includes a variable refresh rate (VRR) detection circuit 121 and a control circuit 122. The VRR detection circuit 121 may receive the video stream VS1 from the video source device 110, and the video stream VS1 includes at least one VRR video frame (e.g., the VRR video frames F1 to F6 shown in FIG. 4).

Figure 7:
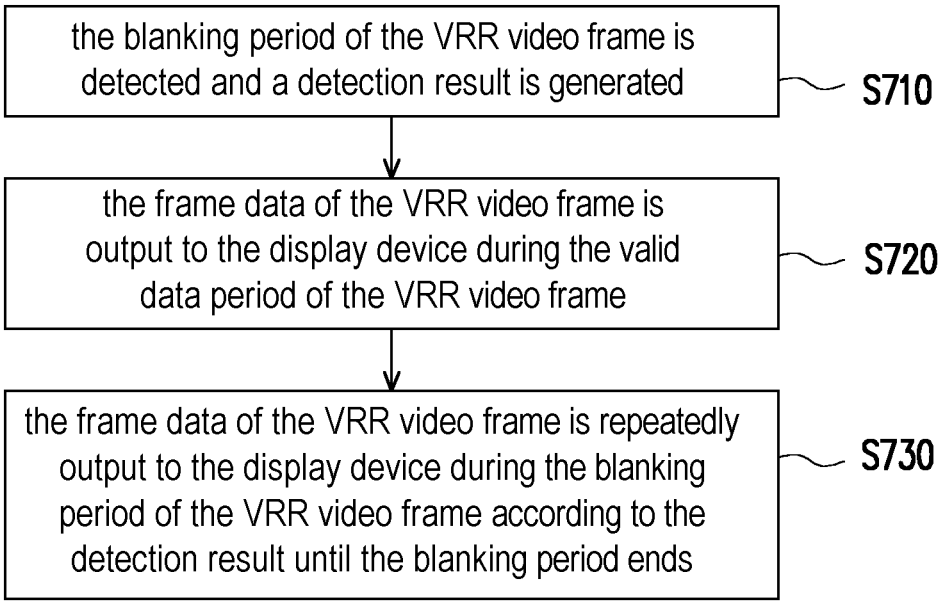
FIG. 7 is a flowchart illustrating a brightness compensation method of the brightness compensation device shown in FIG. 6 according to an embodiment of the disclosure.

FIG. 7 is a flowchart illustrating a brightness compensation method of the brightness compensation device 120 shown in FIG. 6 according to an embodiment of the disclosure. Referring to FIG. 6 and FIG. 7, in step S710, the VRR detection circuit 121 may receive the video stream VS1 from the video source device 110, detect the blanking period of the real-time VRR video frame of the video stream VS1, and generate a detection result DR. The control circuit 122 may receive the video stream VS1 from the video source device 110. The control circuit 122 may also output the frame data of the real-time VRR video frame to the display device to serve as the video stream VS2 during the valid data period of the real-time VRR video frame of the video stream VS1 (step S720).

The control circuit 122 may also output the data enabling information DE to the display device 130. The data enabling information DE may indicate the valid data period of the real-time VRR video frame. The control circuit 122 may also output the vertical synchronization information Vsync to the display device 130. The vertical synchronization information Vsync may indicate the end of the blanking period of the real-time VRR video frame. For the description of the vertical synchronization information Vsync and the data enabling information DE shown in FIG. 6, refer to the related description of the vertical synchronization information Vsync and the data enabling information DE shown in FIG. 5, which is not iterated.

Moreover, the control circuit 122 may also temporarily store the real-time VRR video frame. The control circuit 122 is coupled to the VRR detection circuit 121 to receive the detection result DR. In step S730, the control circuit 122 may repeatedly output the frame data of the real-time VRR video frame to the display device 130 during the blanking period of the real-time VRR video frame according to the detection result DR until the blanking period of the real-time VRR video frame ends.

For example, taking the VRR video frame F2 shown in FIG. 4 as an example, the VRR detection circuit 121 may detect the blanking period F2*b* of the VRR video frame F2 (the real-time VRR video frame) from the video source device 110 and generate the detection result DR for the control circuit 122. The control circuit 122 may temporarily store the frame data D2 of the VRR video frame F2 and output the frame data D2 to the display device during the valid data period F2*d* of the VRR video frame F2. The control circuit 122 may repeatedly output the frame data D2 to the display device 130 during the blanking period F2*b* of the VRR video frame F2 according to the detection result DR until the blanking period of the real-time VRR video frame ends.

The implementation details of the control circuit 122 is not limited thereto in the embodiment, and FIG. 6 illustrates one example among many implementations of the control circuit 122. In the embodiment shown in FIG. 6, the control circuit 122 includes a controller 122*a* and a frame buffer 122*b*. Due to the control of the controller 122*a*, the frame buffer 122*b* may temporarily store the frame data of at least one VRR video frame of the video stream VS1 from the video source device 110. The controller 122*a* is coupled to the VRR detection circuit 121 to receive the detection result DR. The controller 122*a* may output the frame data of the real-time VRR video frame to the display device 130 during the valid data period of the real-time VRR video frame of the video stream VS1. According to the detection result DR, the controller 122*a* may repeatedly output the frame data of the real-time VRR video frame temporarily stored in the frame buffer 122*b* to the display device 130 during the blanking period of the real-time VRR video frame until the blanking period of the real-time VRR video frame ends.

Based on the above, in the embodiments, the brightness compensation device 120 is capable of detecting the blanking period of the real-time VRR video frame. The video source device 110 outputs the frame data to the controller 122*a* during the valid data period of the real-time VRR video frame but does not output frame data to the controller 122*a* during the blanking period of the real-time VRR video frame (refer to the video stream VS1 shown in FIG. 4 for details). During the periods of the same VRR video frame (the real-time VRR video frame), the controller 122*a* not only outputs the frame data to the display device 130 during the valid data period but also repeatedly outputs the frame data of the real-time VRR video frame during the blanking period to display device 130 (until the blanking period of the real-time VRR video frame ends). That is, the display device 130 may keep on refreshing the frame data during the blanking period of the real-time VRR video frame to supplement the charge leaked from the liquid crystal pixels caused by the leakage current. Therefore, the controller 122*a* may compensate for the brightness difference among different VRR video frames.

Although the disclosure has been described with reference to the above embodiments, it will be apparent to one of ordinary skill in the art that modifications to the described embodiments may be made without departing from the spirit and the scope of the disclosure. Accordingly, the scope of the disclosure will be defined by the attached claims and their equivalents and not by the above detailed descriptions.

What is claimed is:

1. A brightness compensation device, comprising:

a variable refresh rate (VRR) detection circuit adapted for receiving a video stream from a video source device, wherein the video stream comprises a VRR video frame, and the VRR detection circuit detects a blanking period of the VRR video frame and generates a detection result; and a control circuit, coupled to the VRR detection circuit to receive the detection result, and adapted for receiving the video stream from the video source device, wherein the control circuit outputs frame data of the VRR video frame to a display device during a valid data period of the VRR video frame, and the control circuit repeatedly outputs the same frame data of the VRR video frame that have been displayed during the valid data period of the VRR video frame to the display device during the blanking period of the VRR video frame according to the detection result until the blanking period ends.

2. The brightness compensation device according to claim 1, wherein the control circuit comprises:

a frame buffer adapted for temporarily storing the frame data of the VRR video frame from the video source device; and a controller coupled to the VRR detection circuit to receive the detection result, wherein the controller outputs the frame data of the VRR video frame to the display device during the valid data period of the VRR video frame, and the controller repeatedly outputs the frame data of the VRR video frame temporarily stored in the frame buffer to the display device during the blanking period of the VRR video frame according to the detection result until the blanking period ends.

3. The brightness compensation device according to claim 1, wherein the control circuit further outputs data enabling information to the display device to indicate the valid data period of the VRR video frame, and the control circuit further outputs vertical synchronization information to the display device to indicate that the blanking period ends.

4. A brightness compensation method, comprising:

detecting a blanking period of a variable refresh rate (VRR) video frame and generating a detection result by a VRR detection circuit;

outputting frame data of the VRR video frame to a display device by a control circuit during a valid data period of the VRR video frame; and repeatedly outputting the same frame data of the VRR video frame that have been displayed during the valid data period of the VRR video frame to the display device by the control circuit during the blanking period of the VRR video frame according to the detection result until the blanking period ends.

5. The brightness compensation method according to claim 4, further comprising:

temporarily storing the frame data of the VRR video frame from the video source device by a frame buffer of the control circuit;

outputting the frame data of the VRR video frame to the display device by a controller of the control circuit during the valid data period of the VRR video frame; and repeatedly outputting the frame data of the VRR video frame temporarily stored in the frame buffer to the display device by the controller during the blanking period of the VRR video frame according to the detection result until the blanking period ends.

6. The brightness compensation method according to claim 4, further comprising:

further outputting data enabling information to the display device by the control circuit, wherein the data enabling information indicates the valid data period of the VRR video frame; and further outputting vertical synchronization information to the display device by the control circuit, wherein the vertical synchronization information indicates that the blanking period ends.

7. A display equipment, comprising:

a video source device adapted for providing a video stream, wherein the video stream comprises a variable refresh rate (VRR) video frame;

a display device; and a brightness compensation device coupled to an output terminal of the video source device and an input terminal of the display device, wherein the brightness compensation device receives the video stream from the video source device, the brightness compensation device detects a blanking period of the VRR video frame, the brightness compensation device outputs frame data of the VRR video frame to the display device during a valid data period of the VRR video frame, and the brightness compensation device repeatedly outputs the same frame data of the VRR video frame that have been displayed during the valid data period of the VRR video frame to the display device during the blanking period of the VRR video frame until the blanking period ends.

8. The display equipment according to claim 7, wherein the brightness compensation device comprises:

a VRR detection circuit adapted for receiving the video stream from the video source device, wherein the VRR detection circuit detects the blanking period of the VRR video frame and generates a detection result; and a control circuit, coupled to the VRR detection circuit to receive the detection result, and adapted for receiving the video stream from the video source device, wherein the control circuit outputs the frame data of the VRR video frame to the display device during the valid data period of the VRR video frame, and the control circuit repeatedly outputs the frame data of the VRR video frame to the display device during the blanking period of the VRR video frame according to the detection result until the blanking period ends.

9. The display equipment according to claim 8, wherein the control circuit comprises:

a frame buffer adapted for temporarily storing the frame data of the VRR video frame from the video source device; and a controller coupled to the VRR detection circuit to receive the detection result, wherein the controller outputs the frame data of the VRR video frame to the display device during the valid data period of the VRR video frame, and the controller repeatedly outputs the frame data of the VRR video frame temporarily stored in the frame buffer to the display device during the blanking period of the VRR video frame according to the detection result until the blanking period ends.

10. The display equipment according to claim 8, wherein the control circuit further outputs data enabling information to the display device to indicate the valid data period of the VRR video frame, and the control circuit further outputs vertical synchronization information to the display device to indicate that the blanking period ends.

11. The display equipment according to claim 7, wherein the video source device comprises:

an interface circuit adapted for receiving an original VRR stream from a host; and a video scaler, coupled to the interface circuit to receive the original VRR stream, and adapted for adjusting resolution of the original VRR stream for generating the video stream for the brightness compensation device.

12. The display equipment according to claim 7, wherein the video source device comprises:

a graphics processor adapted for generating the video stream for the brightness compensation device.

13. The display equipment according to claim 7, wherein the display device comprises:

a display panel;

a driving circuit adapted for driving the display panel; and a timing controller coupled to the brightness compensation device to receive the frame data, data enabling information, and vertical synchronization information, wherein, the data enabling information indicates the valid data period of the VRR video frame;

the vertical synchronization information indicates that the blanking period ends;

the timing controller controls the driving circuit according to the data enabling information, so that the display panel displays frame data of the VRR video frame during the valid data period of the VRR video frame; and the timing controller controls the driving circuit according to the data enabling the timing controller controls the driving circuit according to the data enabling information and the vertical synchronization information, so that the display panel repeatedly displays the frame data of the VRR video frame during the blanking period of the VRR video frame until the blanking period ends.

14. A brightness compensation method of display equipment, comprising:

providing a brightness compensation device with a video stream by a video source device, wherein the video stream comprises a variable refresh rate (VRR) video frame;

detecting a blanking period of the VRR video frame by the brightness compensation device;

outputting frame data of the VRR video frame to a display device by the brightness compensation device during a valid data period of the VRR video frame; and repeatedly outputting the same frame data of the VRR video frame that have been displayed during the valid data period of the VRR video frame to the display device by the brightness compensation device during the blanking period of the VRR video frame until the blanking period ends.

15. The brightness compensation method according to claim 14, further comprising:

detecting the blanking period of the VRR video frame and generating a detection result by a VRR detection circuit of the brightness compensation device;

outputting the frame data of the VRR video frame to the display device by a control circuit of the brightness compensation device during the valid data period of the VRR video frame; and repeatedly outputting the frame data of the VRR video frame to the display device by the control circuit during the blanking period of the VRR video frame according to the detection result until the blanking period ends.

16. The brightness compensation method according to claim 15, further comprising:

temporarily storing the frame data of the VRR video frame from the video source device by a frame buffer of the control circuit;

outputting the frame data of the VRR video frame to the display device by a controller of the control circuit during the valid data period of the VRR video frame; and repeatedly outputting the frame data of the VRR video frame temporarily stored in the frame buffer to the display device by the controller during the blanking period of the VRR video frame according to the detection result until the blanking period ends.

17. The brightness compensation method according to claim 15, further comprising:

further outputting data enabling information to the display device by the control circuit, wherein the data enabling information indicates the valid data period of the VRR video frame; and further outputting vertical synchronization information to the display device by the control circuit, wherein the vertical synchronization information indicates that the blanking period ends.

18. The brightness compensation method according to claim 14, further comprising:

receiving an original VRR stream from a host by an interface circuit of the video source device; and adjusting resolution of the original VRR stream for generating the video stream for the brightness compensation device by a video scaler of the video source device.

19. The brightness compensation method according to claim 14, further comprising:

generating the video stream for the brightness compensation device by a graphics processor of the video source device.

20. The brightness compensation method according to claim 14, further comprising:

receiving the frame data, data enabling information, and vertical synchronization information from the brightness compensation device by a timing controller of the display device, wherein the data enabling information indicates the valid data period of the VRR video frame, and the vertical synchronization information indicates that the blanking period ends;

controlling a driving circuit of the display device by the timing controller according to the data enabling information to drive a display panel of the display device to display frame data of the VRR video frame during the valid data period of the VRR video frame; and controlling the driving circuit by the timing controller according to the data enabling information and the vertical synchronization information to drive the display panel to repeatedly display the frame data of the VRR video frame during the blanking period of the VRR video frame until the blanking period ends.

* * * * *